United States Patent [19]

Jozwicki et al.

[11] 3,948,031

[45] Apr. 6, 1976

[54] DUCT FOR FEEDING FIBERS TO A PNEUMATIC SPINNING CHAMBER HAVING A STATIONARY WHIRL

[75] Inventors: Ryszard Karol Jozwicki; Henryk Kubica; Marianna Teresa Piatkowska, all of Lodz, Poland

[73] Assignee: Instytut Wlokiennictwa, Lodz, Poland

[22] Filed: June 28, 1974

[21] Appl. No.: 484,463

[30] Foreign Application Priority Data

July 2, 1973 Poland ..... 163777

[52] U.S. Cl. ..... 57/58.95; 57/34 B

[51] Int. Cl.[2] ..... D01H 1/12; D02G 1/16

[58] Field of Search ..... 57/58.89–58.95, 34 B, 157 F, 106

[56] References Cited

UNITED STATES PATENTS

| | | | |
|---|---|---|---|
| 3,439,488 | 4/1969 | Bucil et al. | 57/58.95 |
| 3,455,097 | 7/1969 | Rajnoha et al. | 57/58.95 |
| 3,487,626 | 1/1970 | Rajnoha et al. | 57/58.95 X |
| 3,511,044 | 5/1970 | Stary | 57/58.95 X |
| 3,712,042 | 1/1973 | Chrtek et al. | 57/58.95 |
| 3,812,667 | 5/1974 | Marsalek et al. | 57/58.95 X |

*Primary Examiner*—Donald E. Watkins

*Attorney, Agent, or Firm*—Waters, Schwartz & Nissen

[57] ABSTRACT

A duct for feeding fibres to a spinning chamber operating in accordance with the method of pneumatic spinning in a stationary whirl.

As it is seen in the drawing the area of outlet 6 of duct designed for feeding of loose fibres in a stream of air from a fibre opening-feeding device to a spinning chamber is smaller than the sum area of outlets 4 of main nozzles in spinning chamber 3, said area being also smaller than the area of inlet 5 of the said duct. The length of the said duct is greater than the length of processed fibres.

2 Claims, 1 Drawing Figure

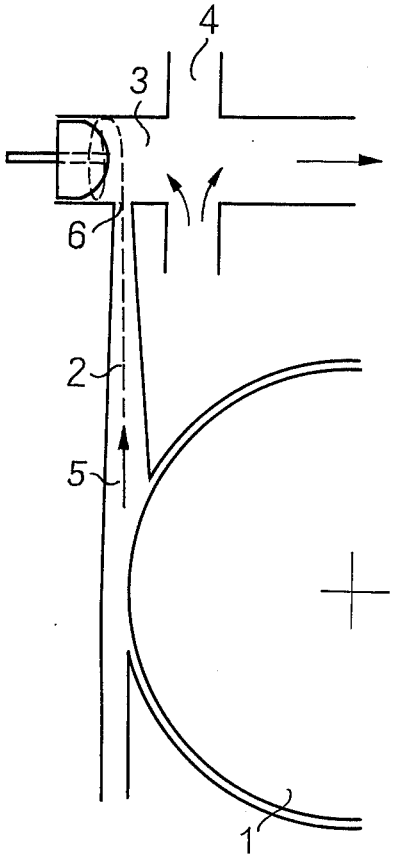
4
3
6
2
5
1

DUCT FOR FEEDING FIBERS TO A PNEUMATIC SPINNING CHAMBER HAVING A STATIONARY WHIRL

A duct for feeding fibres to a spinning chamber operating in accordance with the method of pneumatic spinning in a stationary whirl.

The invention relates to a duct for feeding of fibres in a stream of air from a fibre opening-feeding device to a spinning chamber in which pneumatic forming of yarn takes place from a ring of fibres which are whirling in fixed position in a fixed chamber.

In the state in the art there is no information whatever as regards the construction of ducts for feeding of fibres from a fibre opening-feeding device to a chamber in which the yarn is formed under the action of air.

In the known patent specifications relating to the systems for pneumatic spinning only the position of the duct outlet to the spinning chamber is indicated without specifying the construction of these ducts.

The present invention relates to construction of the duct, the area of the outlet of this duct being smaller than the sum area of the outlets of main nozzles in the spinning chambers, said area of the outlet of the duct being also smaller than the area of the duct inlet, the length of the said duct being greater than the length of the processed fibres.

Due to the fact that the area of the outlet of the duct is smaller than the sum area of the outlets of the nozzles in the chamber, the energy of the stream of air induced into the chamber through the duct is lower than the energy of the stream of air induced through the main nozzles, thus securing that the zone of a stationary whirl of fibres can correctly be established. The different size of the inlet and of the outlet of the duct causes that the velocity of the stream of air induced into the chamber becomes increased, this causing, in turn, that the fibres carried in this stream become straightened and parabolized, and that they are joining the yarn which is being formed so that one fibre is always parallel to the other. The yarn obtained in this manner has an improved strength.

The embodiment of the invention will now be described by way of example with reference to the accompanying drawing in which the invented duct is illustrated in a longitudinal section.

The invented duct has an inlet 5 and an outlet 6, the area of the outlet 6 being smaller than the sum area of outlets of main nozzles 4 in a spinning chamber 3, said area being also smaller than the area of the inlet 5. The inlet 5 of duct 2 is connected with the casing of a fibre opening-feeding device 1, while the outlet 6 is connected with the spinning chamber 3. The outlet of the duct is tangential with the inner wall of the spinning chamber. The duct may be provided with additional holes through which an increased amount of induced air can flow into the duct.

The flow of fibres by means of the invented duct is as follows:

After being opened in the opening-feeding device 1, the fibres are discharged by the said device to the duct 2 where they are caught by the stream of air, said stream of air carrying the said fibres through the said duct 2 to the spinning chamber 3 of a spinning frame. The fibres carried in the stream of air become straightened under the action of an increasing velocity of the air flowing through the duct.

What we claim is:

1. A duct for feeding fibres to a spinning chamber having main nozzles in which the yarn is formed under the action of air and having a stationary whirl, one end of the said duct being connected with a fibre opening-feeding device, the other end of the said duct being connected with a spinning chamber of a spinning frame, said duct tapering in the direction of flow of air through said duct, the area of the duct outlet being smaller than the sum area of the outlets of the main nozzles in the spinning chamber, the length of the said duct being greater than the length of processed fibres.

2. A duct as defined in claim 1 wherein said chamber is stationary, the yarn forming process utilizing the kinetic energy of said air, said air comprising a swirling stream.

* * * * *